US005106042A

United States Patent [19]

Sloane

[11] Patent Number: 5,106,042

[45] Date of Patent: Apr. 21, 1992

[54] DISPLAY POLE ASSEMBLY

[75] Inventor: Jack Sloane, Ozone Park, N.Y.

[73] Assignee: Standard Cellulose & Novelty Co., Inc., Ozone Park, N.Y.

[21] Appl. No.: 492,243

[22] Filed: Mar. 8, 1990

Related U.S. Application Data

[63] Continuation of Ser. No. 252,015, Sep. 27, 1988, abandoned, which is a continuation of Ser. No. 147,591, Dec. 22, 1987, abandoned, which is a continuation of Ser. No. 855,029, Apr. 22, 1986, abandoned.

[51] Int. Cl.[5] ..... A47G 33/00

[52] U.S. Cl. ..... 248/121; 248/159

[58] Field of Search ..... 248/519, 511, 523, 159, 248/121; 211/205; 428/18-20

[56] References Cited

U.S. PATENT DOCUMENTS

| | | | |
|---|---|---|---|
| 1,266,749 | 5/1918 | Abbott | 428/19 |
| 1,298,380 | 3/1919 | Owen | 248/523 |
| 2,517,332 | 8/1950 | Mitchell | 248/519 |
| 2,746,700 | 5/1956 | Barbera | 248/523 |
| 3,142,464 | 7/1964 | Zelenitz | 248/523 |
| 4,357,772 | 11/1982 | Amick | 248/159 |
| 4,557,457 | 12/1985 | Cockfield | 248/222.4 |

FOREIGN PATENT DOCUMENTS

| | | | |
|---|---|---|---|
| 488501 | 12/1952 | Canada | 428/18 |
| 760622 | 6/1976 | Canada | 428/20 |
| 2019456 | 11/1971 | Fed. Rep. of Germany | 211/205 |
| 1015719 | 10/1952 | France | 248/519 |
| 580003 | 7/1958 | Italy | 428/18 |
| 2041747 | 9/1980 | United Kingdom | 428/20 |

*Primary Examiner*—Alvin C. Chin-Shue
*Assistant Examiner*—Robert A. Olson
*Attorney, Agent, or Firm*—Blum Kaplan

[57] ABSTRACT

A display pole assembly for merchandising displays has a base, one or more pole sections with mountings. In supporting display fixtures, and a receptacle for supporting a decorative object. The decorating object may be a tree which is mounted on top of a pole section in which case the pole section may be covered with bark to simulate a portion of the trunk of the tree.

20 Claims, 3 Drawing Sheets

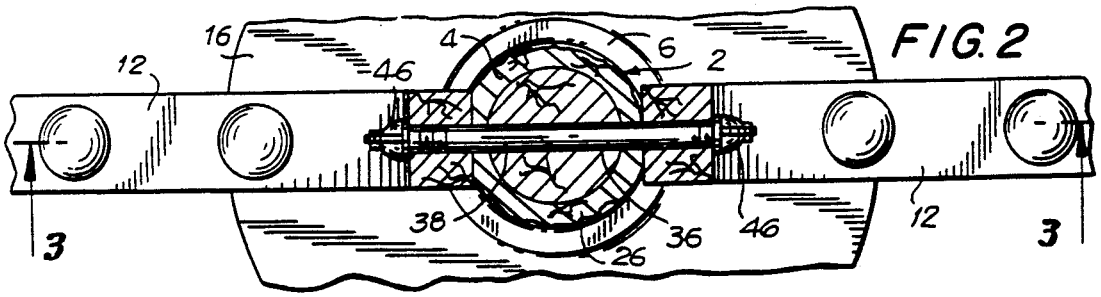
FIG. 2
16
12
46
4
6
2
38
36
26
46
12
3
3
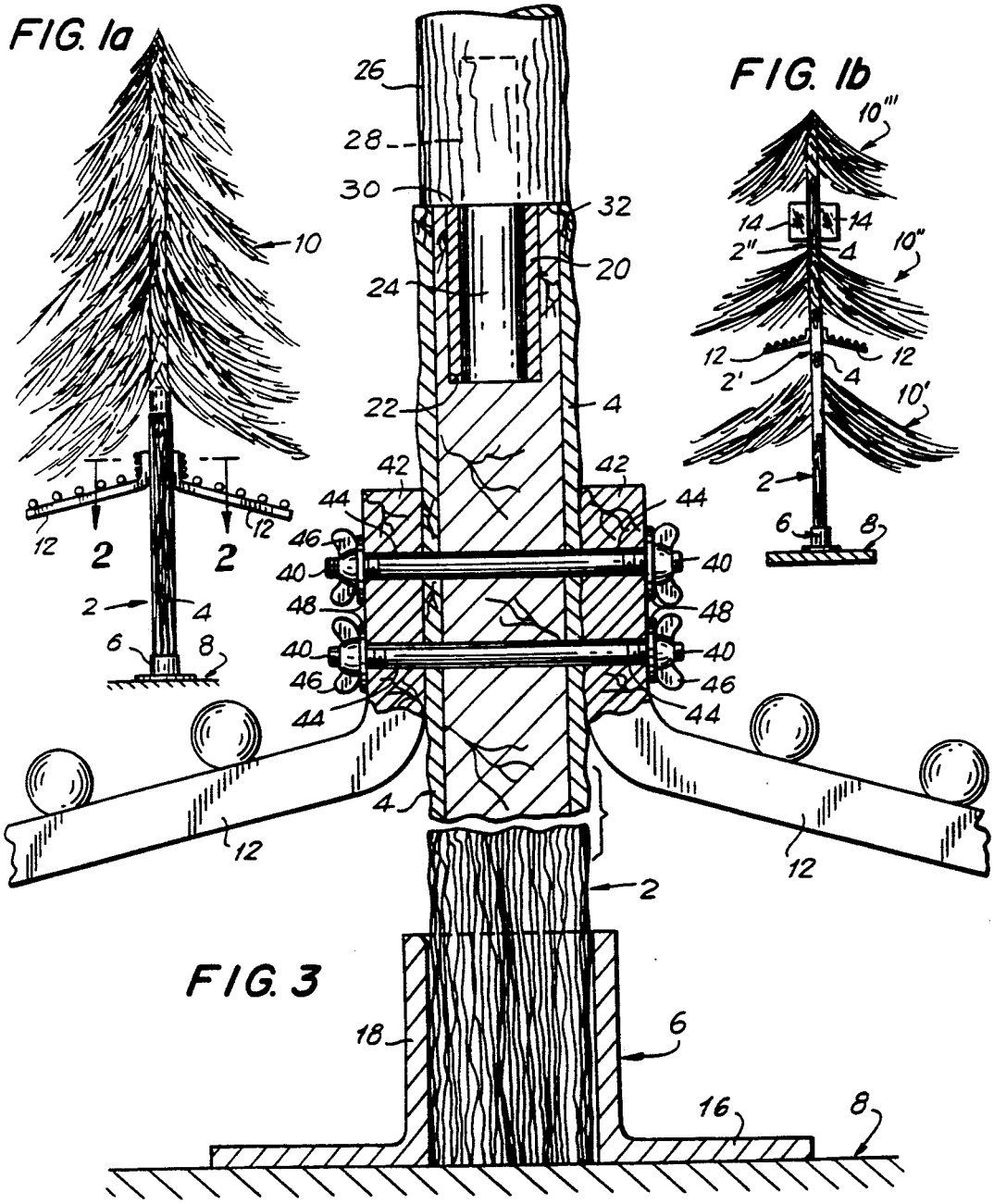
FIG. 1a
FIG. 1b
FIG. 3
10
12
2
2
4
6
8
26
28
30
32
20
24
22
4
42
42
44
44
46
40
48
40
46
44
10'''
14
14
2''
4
10''
12
2'
4
12
10'
2
6
8
4
12
12
2
18
6
16
8

DISPLAY POLE ASSEMBLY

This is a continuation of pending application Ser. No. 07/252,015 filed on Sep. 27, 1988 now abandoned which is a continuation of application Ser. No. 07/147,591 filed on Dec. 22, 1987 now abandoned which is a continuation of application Ser. No. 06/855,029 filed Apr. 22, 1986 now abandoned.

BACKGROUND OF THE INVENTION

The present invention relates to fixtures for use in the display of merchandise. More particularly, the invention relates to the construction of a display pole assembly.

It is customary for merchants to utilize fixtures of various kinds to attract the attention of shoppers to merchandise which is offered for sale. Such fixtures range from a counter top display, where a pedestal-mounted support holds the merchandise to more elaborate structures which rest on the floor of the store or a store window. Such devices are usually plain and utilitarian in nature and, apart from the merchandise, which is displayed upon them, do not make a decorative contribution to the display. To provide decorative surroundings for the merchandise, such as for Christmas displays and the like, the merchant must frequently resort to custom-built structures which serve their purpose for a particular season and which are then either stored or discarded. Such display structures are expensive, since they must be designed and constructed on a one-of-a-kind basis, and are frequently too costly for the small merchant with a tight budget.

What is needed, therefore, is a display structure which is made up of a variety of standard components which can be selected and combined to provide a variety of decorative display structures. The components should lend themselves to mass production so as to be inexpensive, with the various parts being made available via catalog from, for example, the manufacturer or a warehousing distributor.

SUMMARY OF THE INVENTION

The foregoing problem is solved by the present invention in a display pole assembly which consists of a base or pedestal, a pole which is easily assembled and held by the base, and decorative object such as a tree, which is fitted onto the top of the pole. The display pole assembly provides for the attachment of display fixtures such as waterfalls, display panels, hat brackets, goosenecks, hang rails, tie bars, easels, hooks, and the like, which serve as supports for the merchandise to be displayed. The decorative effect, in an illustrative display pole assembly intended for Christmas use, includes a display pole which is made, for example, of the trunk of a cedar tree, and which supports a fir tree, either imitation or real. The pole may be provided in sections so that tree sections may be interspersed between pole sections which carry fixtures, so that the displayed merchandise appears to be supported within, or immediately beneath the tree.

It is an object of the invention to provide a decorative display pole assembly.

It is another object of the invention to provide a decorative display pole assembly which is simply constructed and is capable of assembly by an unskilled worker.

It is still another object of the invention to provide a display pole assembly having a number of interchangeable elements which permit display of a wide variety of objects.

Another object of the invention is to provide a display pole assembly which is capable of providing a wide variety of decorative effects.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

DETAILED DESCRIPTION OF THE DRAWINGS

For a fuller understanding of the invention, reference is had to the following description, taken in connection with the accompanying drawings, in which:

FIGS. 1(*a*) and 1(*b*) are elevational views of two different displays using display pole assemblies according to the teachings of the invention;

FIG. 2 is a sectional view taken along lines 2—2 in FIG. 1(*a*), showing the construction of the display pole and a fixture;

FIG. 3 is an elevational, partially sectional view of the base, display pole, and ornamental tree of FIG. 2, taken along lines 3—3;

Figure 4B:
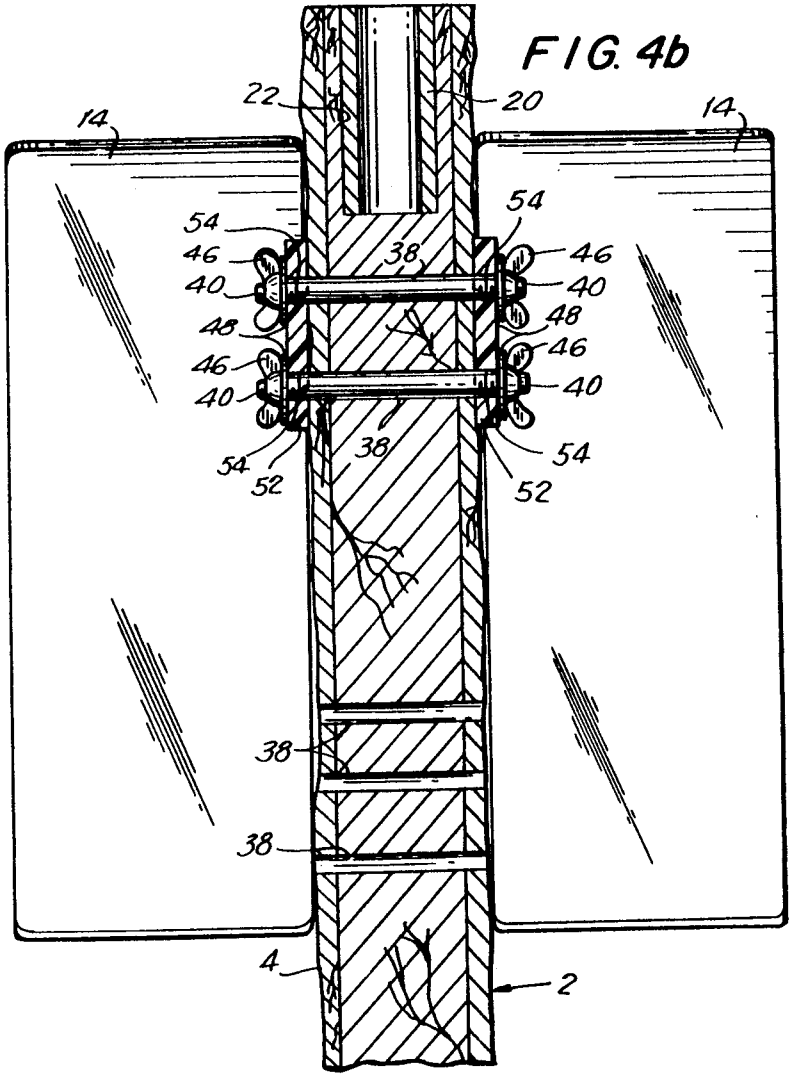
Figure 4A:
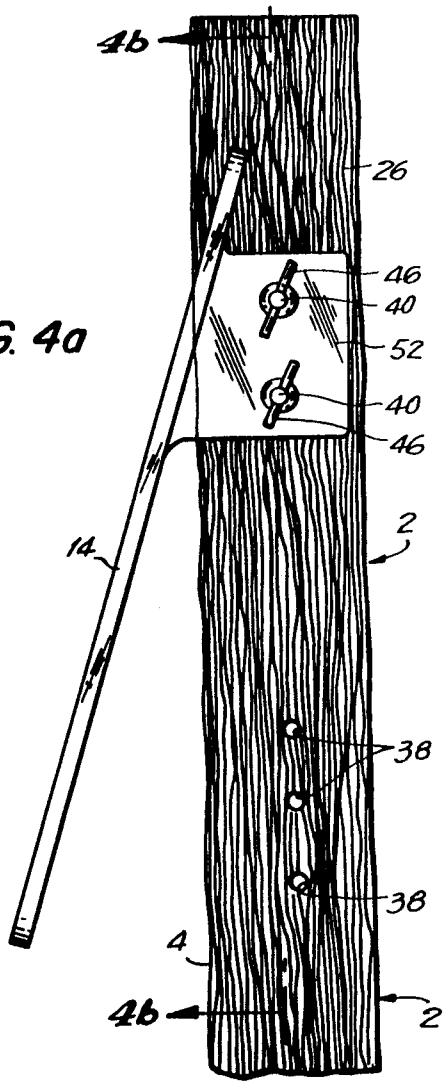
Figure 5B:
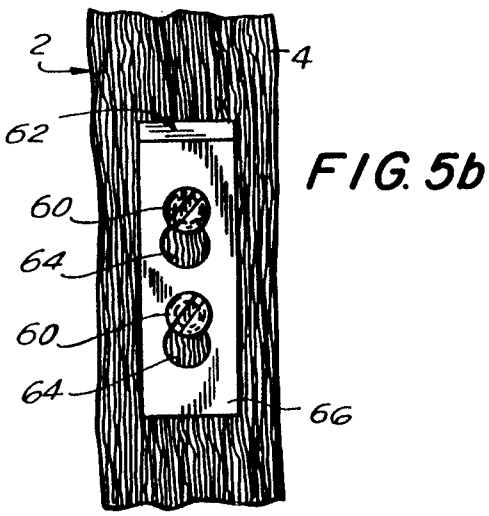
Figure 5A:
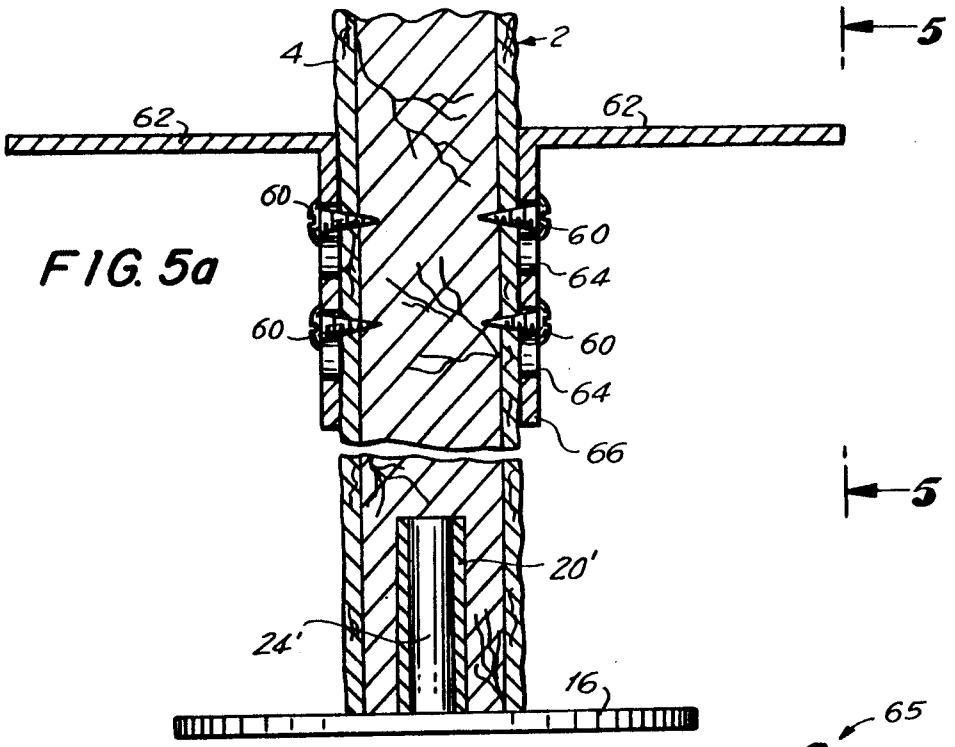
Figure 6C:
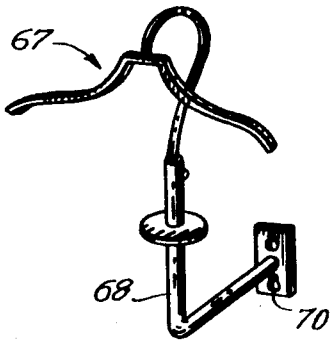
Figure 6B:
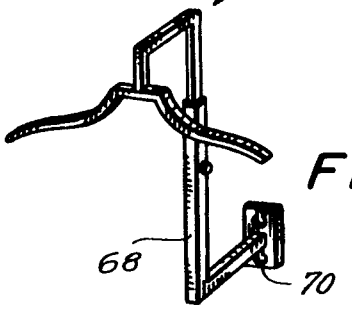
Figure 6A:
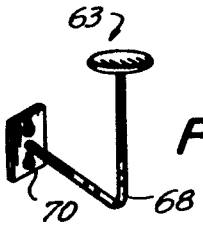

FIGS. 4(*a*) and 4(*b*) are, respectively, an elevational view of a portion of a display pole having an attached easel fixture, and a sectional view taken along lines 4(*b*)—4(*b*) of FIG. 4(*a*);

FIGS 5(*a*) and 5(*b*) are sectional views and side elevational views, respective , of an alternative form of support for a display fixture; and FIGS. 6(*a*), (*b*) and (*c*), illustrate other display fixtures useful with the display pole of the invention.

DESRIPTION OF THE PREFERRED EMBODIMENTS

Reference is first made to FIGS. 1(*a*) and 1(*b*) where two illustrative examples of displays using the display pole constructions in accordance with the invention are depicted. In FIGS. 1(*a*) and 1(*b*), as well as in other figures to be described below, parts which form the same function are identified with the same numbers. The displays of FIGS. 1(*a*) and 1(*b*) utilize display pole sections 2 which are made of natural cedar on which the bark 4 has been retained. The bottom portion of display pole 2 is supported vertically in a flanged steel base tube 6 which, in turn, is attached to a wider base 8 to provide greater stability. A Christmas tree 10 (FIG. 1(*a*)) is mounted vertically at the upper end of a display pole section of substantial length 2. As shown in FIG. 1(*b*), the Christmas tree may be provided in sections 10', 10', and 10''', of varying lengths and widths, which are supported by intervening display pole portions 2' and 2'', also of varied lengths, as shown in FIG. 1(*b*). Removably attached to display pole 2 in FIG. 1(*a*) are a pair of ball waterfalls 12 for the display of merchandise which can be suspended. In FIG. 1(*b*), the display fixtures include ball waterfalls 12 on display pole 2' and display panels 14 on display pole 2''. It is to be understood that while a fir tree serves as the decorative motif in the illustrative embodiments of FIGS. 1(*a*) and (*b*), other trees, such as palm trees, etc., may be used. In fact the tree-like decorative attachment need not be a tree but can be some other decorative element.

The manner in which the different parts of the display pole assembly are constructed and fit together is best seen in FIGS. 2 and 3. Support tube 6 is secured to, as by welding, to a flange 16 which rests and which conventionally provides for fastening, by means now shown, to a wider base 8. The base of display pole section 2 is fitted closely within vertically projecting support tube 6 which is of sufficient length to provide lateral support for maintaining the display assembly upright. The upper end of display pole section 2 contains an axially disposed cylindrical sleeve 20 which is embedded in an axial box 22 in the end thereof. Display pole section 2 may be made of wood, such as a length of cedar with the bar retained. A support pin 24, which is axially secured in the base of decorative tree 10, is slidably received within support sleeve 20 and supports the tree 10 in a vertical position. Support pin 24 is held in a conforming axial recess 28 in base 26 of the tree, being secured therein by means of epoxy or other convenient cement. As shown in FIG. 3, the bottom surface 30 of tree trunk 26 is at a right angle to the axis of the tree trunk so as to smoothly abut the right angled upper surface 32 of display pole section 2.

To facilitate the mounting and support of accessory display fixtures, such as waterfalls 12 and panels 13 of FIGS. 1(*a*) and 1(*b*), each display pole section 2 of FIG. 3 is provided with at least one pair of closely spaced, transverse mounting holes 36. A pair of mounting bolts 38, having threaded ends 40 are passed into the holes, and holes 44 are fitted over the projecting mounting portions 42 of waterfalls 12 in ends 40. Wing nuts 46 which are screwed onto threaded ends 40 and which abut against washers 48, serve to secure waterfalls 12 against display pole section 2. The foregoing construction provides an inexpensive construction, using standardized parts, by means of which a variety of display fixtures may be assembled to provide a variety of decorative effects. It is to be noted, particularly, that the display pole sections of the invention are provided in a variety of lengths and that the mounting holes 36, which can be single or multiple, can be provided at different positions, and at more than one position, along the length of each section, thus facilitating the decorator's range of choices. While other types of tree, associated with a particular season suggest themselves, the invention is capable of application to other decorative solutions to the merchant's display problem.

Other display fixtures and accessories which can be supported on display pole 2 are shown in FIGS. 4(*a*) and 4(*b*), where a pair of angled, transparent display panels are depicted, attached to a display pole section 2, using the bolts and wing nuts described above in connection with FIGS. 2 and 3. Each display panel 14 is provided with an integral, rearward projecting tab 52 which contains a pair of bolt holes 54 through which threaded ends 40 of bolts 38 can pass. The attachment of tabs 52 to the pole section thus provides solid support for the display, while providing for ready attachment and removal thereof. A set of three holes 38' is provided for convenience of the decorator in positioning the display.

An alternate form of attachment for display fixtures is illustrated in FIGS. 5(*a*) and (*b*), where, instead of through-bolts, a pair of screws 60 is partially driven into the material of display pole section 2 at each location where a display fixture 62 is to be attached. A portion of each screw is left projecting beyond the surface of display pole 2 to serve as a seat for the narrow portion of a mating keyhole slot 64 in the associated display fixture support 66. The position of the screws along the length of the display pole can be predetermined by the manufacture, or the choice can be left to the display designer, who manually inserts the screws at the time of assembly. Other forms of attachment useful with the structure of the invention include simple nails, pins, hooks, weldments, solder(when metal poles are used), glue, cements, etc. Also shown in FIG. 5 is an alternative supporting base arrangement in which a pin 24', fastened to base plate 16 is received in a reinforcing sleeve 20.

FIGS. 6(*a*), (*b*) and (*c*) illustrate some of the wide variety of display fixtures which can be provided for use with display pole assemblies in accordance with the invention. As shown, support portions 68 of hat bracket 63 (FIG. 6(*a*)), clothes hanger 65 (FIG. 6(*b*)), and goose-neck 67 of (FIG. 6(*c*)) are each provided with at least two keyhole slots 70 for quick mounting onto the display pole sections.

It is to be understood that, while the invention has been described in the context of a Christmas display in which the decorative effects are obtained by the use of sections of a cedar pole along with a Christmas tree as decorative elements in a display, display poles of a different character may be used. Thus, desirably display poles have surfaces which are textured to complement the overall effect which the decorator wishes to achieve, and can be metal, plastic, composition, and the line.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A display pole assembly comprising:

an elongate member;

pedestal means for engaging one end of the elongate member to maintain it in an upright position;

decorative means, comprising at least a portion of a tree trunk with at least one branch, supported on the other end of the elongate member providing a distinct decorative environment for display of merchandise on the fixture;

at least one display fixture not in the form of a tree branch, said display fixture including display support means specifically adapted for exhibiting merchandise not associated with trees; the display support means including at least a second elongate member having a plurality of beads thereon for supporting merchandise on the second elongate member, the second elongate member being affixed to the first elongate member; and means on the elongate member intermediate the pedestal and the decorative means for supporting said display fixture.

2. The display pole assembly of claim 1 wherein the elongate member has a receptacle at each end.

3. The display pole assembly of claim 1 wherein the pedestal means comprises:

a baseboard; and a tubular receptacle on the baseboard in which the one end of elongate member is slidably received.

4. The display pole assembly of claim 1 wherein the elongate member has a receptacle at the one end and in which the pedestal means further comprises:

a baseboard; and an upright pin centered on the baseboard for engaging the receptacle in the elongate member.

5. The display pole assembly of claim 1 wherein the means for supporting a display fixture further comprises:

a pair of holes through the body of the elongate member for receiving mounting screws.

6. The display pole assembly of claim 1 wherein the means for supporting a display fixture further comprises:

a pair of screws in the side of the elongate member, the screws having heads which are spaced apart from the surface of the support member to receive a fixture mounting.

7. The display pole assembly of claim 1 wherein the decorative appearance of the elongate member substantially matches that of the tree trunk.

8. The display pole assembly of claim 7 wherein the portion of a tree is a natural tree and the elongate member is a natural tree trunk.

9. The display pole assembly of claim 1 and further comprising:

a receptacle in one of the one end of the elongate member and the tree trunk; and a mounting pin projecting axially from one of the other of the bottom of the tree trunk and the elongate member, the mounting pin fitting slidably in the receptacle to support the portion of the tree.

10. The display pole assembly of claim 9 wherein the elongate member is made of wood and wherein the receptacle is reinforced to prevent splitting of the wood.

11. The display pole assembly of claim 10 wherein the receptacle comprises:

a reinforcing sleeve in the elongate member.

12. The display pole assembly of claim 1 wherein there are at least two elongate members, and further comprising:

a section of a tree with at least one branch interposed between the elongate members.

13. The display pole assembly of claim 1 wherein the at least one of the elongate members has a receptacle on each end.

14. The display pole assembly of claim 12 wherein the means for supporting a display fixture further comprises:

a pair of holes through the body of at least one elongate member for receiving mounting screws.

15. The display assembly of claim 12 wherein the means for supporting a display fixture further comprises:

a pair of screws in the side of an elongate member, the screws having heads which are spaced apart from the surface of the member to receive a fixture mounting.

16. A display pole assembly comprising:

an elongate member;

pedestal means for engaging one end of the elongatc member to maintain it in an upright position;

decorative means, comprising at least a portion of a tree trunk with at least one branch, supported on the other end of the elongate member providing distinct decorative environment for display of merchandise on the fixture;

at least one display fixture not in the form of a tree branch, said display fixture including display support means specifically adapted for exhibiting merchandise not associated with trees; so that the merchandise is clearly visible from away from the display pole assembly to permit the display of said merchandise for sale; said display support means including ball waterfalls adapted to support merchandise; and means on the elongate member intermediate the pedestal and the decorative means for supporting said display fixture.

17. The display pole assembly of claim 16, wherein the decorative appearance of the elongate member substantially matches that of the tree trunk.

18. The display pole assembly of claim 17, wherein the portion of the tree is a natural tree and the elongate member is a natural tree trunk.

19. The display pole assembly of claim 16, and further comprising:

a receptacle in one of the one end of the elongate member and the tree trunk; and a mounting pin projecting axially from one of the other of the bottom of the tree trunk and the elongate member, the mounting pin fitting slidably in the receptacle to support the portion of the tree.

20. The display pole assembly of claim 19, wherein there are at least two elongate members, and further comprising:

a further trunk portion with branches of a tree interposed between the elongate members.

* * * * *